United States Patent [19]

Skabla

[11] 4,349,697

[45] Sep. 14, 1982

[54] SOUND REPRODUCTION SYSTEM

[76] Inventor: Joseph Skabla, 2601 S. Kingshighway, St. Louis, Mo. 63139

[21] Appl. No.: 134,338

[22] Filed: Mar. 26, 1980

[51] Int. Cl.[3] ..... H04R 3/14

[52] U.S. Cl. ..... 179/1 D; 179/1 J

[58] Field of Search ..... 179/1 G, 1 GP, 1 D, 179/1 J; 84/1.25

[56] References Cited

U.S. PATENT DOCUMENTS

| | | | |
|---|---|---|---|
| 2,837,597 | 6/1958 | Lubow | 179/1 GP |
| 3,657,480 | 4/1972 | Cheng et al. | 179/1 D |
| 4,039,755 | 8/1977 | Berkovitz | 179/1 J X |

FOREIGN PATENT DOCUMENTS

| | | | |
|---|---|---|---|
| 174223 | 3/1953 | Fed. Rep. of Germany | 179/1 GP |
| 865578 | 4/1961 | United Kingdom | 179/1 GP |

*Primary Examiner*—Joseph A. Popek

*Attorney, Agent, or Firm*—Gravely, Lieder & Woodruff

[57] ABSTRACT

A system for converting an audio signal into a three dimensional phased sound that simulates the performance of live music in an acoustically superior music hall includes a signal divider which separates the audio signal into dimensions, that is into high, low, and intermediate frequency components. Each component after being amplified powers a separate loud speaker so that the sound emitted by the three speakers is in phase with the audio signal. In addition, each component is directed through a delay device where it is delayed on the order of 20–300 milliseconds, with the delay for each of the three components being different. The delayed signal components, after being amplified, power separate loud speakers so that the sound which emerges from these speakers is the same as the sound produced at the other speakers, but is slightly out of phase. Moreover, the magnitude of the delay varies between the high, low, and intermediate frequency ranges with the delay being greatest for the high frequency range. The overall effect is to prolong the initial in phase sound and thereby significantly enhance the brilliance and richness of the reproduced music. Indeed, the reproduced sound closely simulates the acoustics of a fine music hall.

16 Claims, 1 Drawing Figure

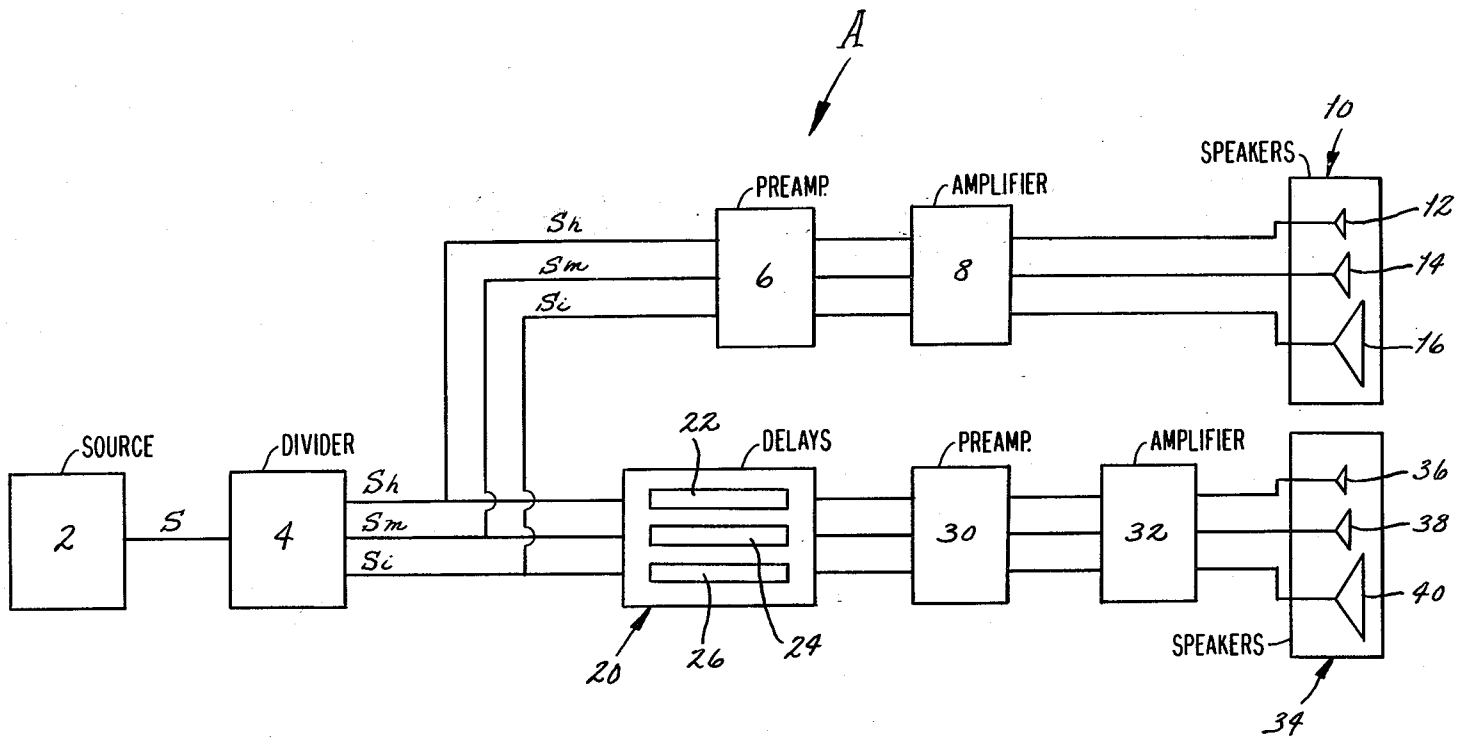
A
SOURCE
2
S
DIVIDER
4
Sh
Sm
Sl
PREAMP.
6
AMPLIFIER
8
SPEAKERS
10
12
14
16
DELAYS
20
22
24
26
PREAMP.
30
AMPLIFIER
32
SPEAKERS
34
36
38
40

SOUND REPRODUCTION SYSTEM

BACKGROUND OF THE INVENTION

This invention relates in general to the reproduction of sound and more particularly to an apparatus and process for simulating in reproduced music the acoustical characteristics of fine music halls.

Music when performed out-of-doors lacks richness and is often described as being dead, and while this music may not be unpleasant to the average listener, the listener nonetheless realizes that the music is deficient in some respect. More often than not he attributes the deficiency to the musicians. On the other hand, the acoustical characteristics of a few music halls throughout the world impart a high degree of brilliance and richness to music performed in them, and consequently these music halls can flatter the performances of otherwise mediocre musicians. Carnegie Hall in New York City has perhaps the best acoustics for performing both choral and instrumental music. London, Stockholm, Vienna, Belgrade, and Moscow also have very fine music halls.

Generally speaking, music performed indoors sounds far superior to the same music performed outdoors, and this difference is easily detected even by those who are not well versed in music, for the indoor music has a richness and brilliance that the outdoor music lacks. The difference is attributable to the acoustics of the enclosure in which the music is performed. For example, a musical sound when produced within an enclosure, will not terminate immediately, even though the sound is actually terminated at its source. Quite to the contrary, the sound tends to "hang on" since it continues to reflect off of the surfaces of the enclosure. The result is a decay which varies with frequency in that the high frequency sounds decay slower, or in other words hang on longer, then the low frequency sounds. In contrast to an echo, the reflected sound follows the initial sound so closely that it cannot be distinguished as a separate sound. The sound-prolonging characteristics of any enclosure are to a large measure dependent upon both the size and shape of the enclosure and also the materials from which the enclosure is constructed, particularly those materials that form the surface areas within the enclosure. Indeed, some materials even resonate, causing the listener to feel enveloped in sound, this being particularly true of the wood panelled music rooms of Europe.

Recorded music never seems to possess the richness and brilliance of live music, at least when compared with live music performed in a music hall of superior acoustics. Indeed, even when the recorded music is derived from a performance in a very fine music hall and is reproduced over the finest playback equipment, it still seems to lack brilliance and richness. Attempts to improve the quality of recorded music have resulted in the development of high fidelity, stereophonic, and even quadraphonic recordings, as well as highly sophisticated playback equipment for handling these improved recordings. In spite of these developments, it seems impossible to capture the acoustics of a fine music hall to the fullest extent.

SUMMARY OF THE INVENTION

One of the principal objects of the present invention is to provide a system and process for reproducing musical sounds as if they were performed in an acoustically superior music hall. Another object is to provide a system and process of the type stated which is suitable for reproducing recorded music, irrespective of the recording medium or the number of channels in which the music is recorded. An additional object is to provide a system and process of the type stated that is simple in construction and relatively inexpensive to construct. A further object is to provide a system and process that effectively simulates the acoustics of fine music halls and can be altered to simulate performances in different music halls. Still another object is to provide a system and process of the type stated that produces three dimensional phased sound. These and other objects and advantages will become apparent hereinafter.

The present invention is embodied in an apparatus including means for dividing an audio signal into a plurality of components with each component containing frequencies of a different range, first speaker means for converting the components of the signal into audible sounds, delay means for delaying the individual components, and second speaker means for converting the delayed components into an audible sound that is slightly out of phase with the sound emitted from the first speaker means. The delay is such that the out of phase sounds produced at the second speaker means simulate the reflective effects that occur within a fine music hall. The invention also resides in the process of dividing the audio signal into components, converting the components into audible sound, delaying each of the components, and also converting the delayed components into a second audible sound that is slightly out of phase with the first audible sound. The invention also consists in the parts and in the arrangements and combinations of parts hereinafter described and claimed.

DESCRIPTION OF THE DRAWINGS

The single FIGURE of the drawing schematically illustrates the sound reproducing apparatus of the present invention in the form of a block diagram.

DETAILED DESCRIPTION

The sound system A of this invention is particularly adapted for reproducing music, irrespective of whether it is recorded or live, and like practically all sound reproduction systems, converts an audio signal S carrying many frequencies into audible sound. The signal S may be derived from any of a number of sources, but irrespective of its source, the signal S is divided to separate its low, intermediate, and high frequency components. Each of these components, after being amplified, is converted to primary audible sounds through a suitable speaker, with this conversion occuring instantaneously so that the primary sounds are in phase with the signal S. In addition, each of the components of the signal S passes through a delay device where the component is delayed in time and thereby placed out of phase with audio signal S. The delays for the various components differ. The delayed components are then converted into secondary audible sounds, which are the same as the primary sounds, except that they are slightly out-of-phase with the primary sounds and may be of lesser intensity. Moreover, the delay is so short that the secondary sounds are not discernible as such. Nevertheless, they provide the reproduced music with a brilliance and richness that is not available even with the most sophisticated recording and playback equipment. Indeed, the overall effect simulates the acoustics of a fine music hall.

The audio signal S that is converted into audible sound by the system A is electrical in nature and carries a multitude of frequencies corresponding the frequencies in the music that is to be reproduced. The audio signal S is derived from a source 2 which may be any of a wide variety of equipment currently available for producing such signals. For example, the source 2 may be a machine for playing disk-type records. In this instance, the signal S is generated at a stylus which follows the groove of a record disk, and through the piezoelectric effect converts undulations in that groove into an electrical signal S. The source 2 may also be a machine for playing magnetic tapes, and in this instance the signal S is derived from a magnetic reproducing head past which the tape moves.

The source 2 is not limited exclusively to playback equipment, for it may also be the tuner of radio receiver or even a microphone in front of a performing group at a remote location. Furthermore, the signal S should be monophonic, in which case it is transmitted to the system A through a single electrical path or channel. Where multiple audio signals are available such as in the case of stereophonic or even quadraphonic recordings, the multiple channels or paths along which these signals pass may be combined into a single channel within the system A so that the system A actually produces the audible sound from a single audio signal S. The signal S, irrespective of its derivation, will usually contain voltage fluctuations at a multitude of frequencies representing and corresponding to the various frequencies at which the music is performed.

The system A includes a signal divider 4, which is actually an electronic filter that divides the signal S into three different components—namely a high frequency component $S_h$, an intermediate or midrange frequency component $S_m$, and a low frequency component $S_l$. The high frequency component $S_h$ contains all those frequencies in the original signal that are above a predetermined frequency such as 2000 Hz, while the low frequency component contains all frequencies that are below a predetermined frequency such as 200 Hz. Of course, the intermediate frequency component $S_m$ contains all frequencies between the high and low frequency components $S_h$ and $S_l$, and in the case of the previous limits will range between 200 and 2000 Hz. Actually the high frequency component $S_h$ may have frequencies as high as 2000 Hz, whereas the low frequency component $S_l$ may have frequencies as low as 20 Hz.

Each signal component $S_h$, $S_m$, and $S_l$ then passes into a preamplifier 6 where it is separately amplified and then on to a main amplifier 8 where it is separately amplified still further.

Beyond the main amplifier 8 is a speaker unit 10 consisting of at least three speakers—namely a high frequency speaker or tweeter 12, a midrange speaker 14, and a low frequency speaker or woofer 16. The high frequency component $S_h$, after being amplified in the main amplifier 8 is directed to the tweeter 12. Similarly, the amplified intermediate frequency component $S_m$ is directed to the midrange speaker 14, while the amplified low frequency component $S_l$ is directed to the woofer 16. Thus, the speaker unit 10 produces an audible sound from the three components $S_h$, $S_m$, and $S_l$ of the original audio signal S, and that sound is in phase with the original signal S. In other words, the individual frequencies of the components $S_h$, $S_m$, and $S_l$ are reproduced at the speakers 12, 14 and 16 instantaneously with their appearance in the original signal S at the source 2. The result is a three dimensional primary sound containing the entire range of frequencies in the audio signal S, but the primary sound in-and-of itself lacks somewhat in richness and brilliance as is somewhat typical of reproduced sound.

Each signal component $S_h$, $S_m$, and $S_l$ that is produced by the signal divider 4 is also directed to a unit 20 containing three separate delay devices—namely a delay device 22 for the high frequency component $S_h$, another delay device 24 for the intermediate frequency component $S_m$, and still another delay device 26 for the low frequency component $S_l$. The delay devices 22, 24, and 26 delay the signal components $S_h$, $S_m$, and $S_l$, respectively, so that the signal components $S_h$, $S_m$, and $S_l$, upon emerging from the unit 20 are somewhat out of phase with the original signal S and its undelayed components $S_h$, $S_m$, and $S_l$. The delay in each of the devices 22, 24, and 26 is normally less than one second, usually ranging between 20 and 300 milliseconds. Moreover, the delay varies between the devices 22, 24, and 26, with the delay in the devices 22 and 24 tending to be longer than the delay in the device 26 for the low frequency component $S_l$. The delays produced in the unit 20 are tailored to the particular acoustic effect one is seeking to simulate, such as the acoustics of a well known music hall. For example, to simulate the acoustics of Carnegie Hall in New York City, the delay in high frequency device 22 should be about 150 milliseconds; the delay in the intermediate frequency device 24 should be about 105 milliseconds; and the delay in the low frequency device 26 should be about 45 milliseconds. Since one may wish to simulate the acoustics of different music halls, the unit 20 should be capable of being easily detached and replaced with another unit having different delays in its delay devices 22, 24, and 26. This same end may be achieved by making the individual devices 22, 24, and 26 adjustable so that their time delays may be varied.

The delayed signals $S_h$, $S_m$, and $S_l$ upon emerging from the unit 20 each pass into another preamplifier 30 where they are individually amplified and then on to another main amplifier 32 where they are amplified still further.

The delayed and amplified signal components $S_h$, $S_m$, and $S_l$ are directed to a separate speaker unit 34 containing three separate speakers, namely a high frequency speaker or tweeter 36, a midrange speaker 38, and a low frequency speaker or woofer 40. More specifically, the delayed high frequency signal component $S_h$ is directed to the tweeter 36 where it is converted into an audible sound that is the same as the sound produced by the tweeter 12, but is slightly out of phase with the sound emerging from the tweeter 12 and perhaps at a lower intensity. The time span between the reproduction of the same sounds by the two tweeters 12 and 36 is of course the time delay of the delay device 22, and that delay is so short that the two sounds cannot be individually distinguished. Indeed, the delayed sound from the tweeter 36 causes the initial high frequency sound to remain alive or hang on so-to-speak, thereby adding richness to the initial sound without appearing as an echo. Similarly, the delayed signal component $S_m$ powers the midrange speaker 38, causing it to emit a sound that is the same as the sound produced at the midrange speaker 14, only it is delayed by the amount of the time delay in the delay device 24 and is of slightly lower intensity. Again the delayed sound from the speaker 38 prolongs the initial midfrequency sound from the speaker 14. Likewise, the delayed low frequency component $S_l$, after being amplified, is directed to the woofer 40 where it is reproduced as the same sound that is emitted from the woofer 16, only the sound at the woofer 40 is delayed by the time delay of the circuit 26 and has lower intensity. Thus, the sound emitted by the woofer 40 imperceptibly extends the initial in phase sound at the woofer 16. In essence, the speaker unit 34 emits a secondary sound that contains the same full range of frequencies as the primary sound emitted from the speaker unit 10, but is of less intensity and out of phase, with the delay depending on and varying between the frequency ranges. The end result is a three dimensional phased sound.

Each delay device 22, 24, or 26 may constitute nothing more than thin steel wire that is preferably wound into a spiral. Resistance-type heating element wire is suitable for this purpose. The delay devices 22, 24, and 26 may also be electronic circuits containing diodes, crystals, transistors, or other electronic devices.

The two speaker units 10 and 34 should be generally at the same location, and indeed, the speakers of each may be intermixed. For example, excellent results are obtained when the two tweeters 12 and 36, the two midrange speakers 14 and 38, and the two woofers 16 and 40 are arranged together in pairs.

Since the music that is derived from the audio signal S is reproduced both instantaneously through the speaker unit 10 as a primary sound and with slight delay through the speaker unit 34 as a secondary sound, the overall effect is one of brilliance and richness, since the secondary sound emerging from the speaker unit 34 prolongs the sound derived from the speaker unit 10. Thus, the sounds from the three speakers 12, 14, and 16 of the speaker unit 10 tend to hang on and resemble the kaleidoscope of sound prevelant in a good music hall. In short, the sound acquires a three dimensional phased effect, because each speaker 36, 38, 40 of the speaker unit 34 is out of phase with its corresponding speakers 12, 14, and 16 in the speaker unit 10 by a different time span. This reproduces the acoustical effect of a fine music hall where the high frequency sounds have a greater life span than the midfrequency sounds, and the mid-frequency sounds have a greater life span than the low frequency sounds.

By varying the time delays in the three frequency ranges it is possible to simulate the acoustics of different music halls. The acoustic properties of such halls are to a large measure dependent upon their size and configuration, and when only these parameters are taken into consideration, it is possible to calculate the delays necessary for the delay devices 22, 24, and 26 in order to simulate the acoustics of such a music hall, or more specifically simulate the sound heard by one sitting generally in the balcony midway between the stage and the back wall and midway between the sidewalls.

This invention is intended to cover all changes and modifications of the example of the invention herein chosen for purposes of the disclosure which do not constitute departures from the spirit and scope of the invention.

What is claimed is:

1. An apparatus for producing audible sound from an electrical audio signal containing various frequencies, said apparatus comprising: means for dividing the signal into low frequency, high frequency, and intermediate frequency components, with the low frequency component containing frequencies primarily below the intermediate frequency component, the high frequency component containing frequencies primarily above the intermediate frequency component, and the intermediate frequency component containing frequencies primarily above the low frequency component and primarily below the high frequency component; first speaker means for converting the components of the signal into primary audible sounds; delay means for delaying the individual components of the signal, with the high and intermediate frequency components being delayed longer than the low frequency component; and second speaker means for converting the delayed components into secondary audible sounds, the delay causing the secondary sounds emerging from the second speaker means to be out of phase with respect to the primary sounds emerging from the first speaker means, the delay being such that the out of phase secondary sounds imperceptibly prolong the primary sound such that the combined primary and secondary sounds simulate the acoustics of a fine music hall.

2. An apparatus according to claim 1 wherein the delay means delays each of the signal components for a different time.

3. An apparatus according to claim 2 and further comprising first amplifier means for amplifying the undelayed components and second amplifier means for amplifying the delayed components.

4. An apparatus according to claim 3 wherein the second amplifier means amplifies the delayed components to a lesser extent than the first amplifier means amplifies the primary components so that the secondary sounds emerging from the second speaker means are at a lower intensity than corresponding primary sounds emerging from the first speaker means.

5. An apparatus according to claim 1 wherein the first speaker means includes a separate loud speaker for each component of the signal that produces the primary sounds.

6. An apparatus according to claim 5 wherein the second speaker means includes a separate loud speaker for each delayed component of the signal that produces the secondary sounds.

7. An apparatus according to claim 6 wherein the loud speakers of the first and second speaker means are located in close proximity to each other.

8. An apparatus according to claim 1 wherein the delay means delays the high frequency component longer than the intermediate frequency component and delays the intermediate frequency component longer than the low frequency component.

9. An apparatus according to claim 1 wherein the delay means delays each of the signal components between 20 and 300 milliseconds.

10. An apparatus according to claim 1 wherein the low frequency component contains frequencies primarily below about 200 Hz, the high frequency component contains frequencies primarily above about 2000 Hz, and the intermediate frequency component contains frequencies primarily between about 200 Hz and 2000 Hz.

11. A process for reproducing musical sounds from an audio signal containing a wide range of frequencies corresponding to the frequency of the music that is to be reproduced, said process comprising: dividing the audio signal into low frequency, high frequency, and intermediate frequency components with the low frequency component containing primarily frequencies below the intermediate frequency component, the high frequency component containing frequencies primarily above the intermediate frequency component, and the intermediate frequency component containing frequencies primarily above the low frequency component and primarily below the high frequency component; converting the signal components into a primary audible sound; delaying each of the signal components for a short duration with the high and intermediate frequency components being delayed longer than the low frequency component; and converting the delayed signal components into a secondary audible sound which is substantially the same as the primary sound, but is slightly out of phase with respect to the primary sound, the delay being such that the secondary sound prolongs the primary sound and simulates the acoustics of a fine music hall, so that the primary and secondary sounds seem as if they are the result of a musical performance in a fine music hall.

12. The process according to claim 11 wherein each signal component is delayed for a different duration.

13. The process according to claim 11 wherein the secondary sound derived from the delayed components are at a lower intensity than the primary sounds derived from the primary components.

14. The process according to claim 11 wherein the high frequency component in the delayed signal is delayed longer than the intermediate frequency component, and the intermediate frequency component is delayed longer than the low frequency component.

15. The process according to claim 11 wherein the low frequency component contains frequencies primarily below about 200 Hz, the high frequency component contains frequencies primarily above about 2000 Hz, and the intermediate frequency component contains frequencies primarily between about 200 Hz and about 2000 Hz.

16. The process according to claim 11 wherein each of the components is delayed between 20 and 300 milliseconds.

* * * * *

UNITED STATES PATENT AND TRADEMARK OFFICE

CERTIFICATE OF CORRECTION

PATENT NO. : 4,349,697

DATED : September 14, 1982

INVENTOR(S) : Joseph Skabla

It is certified that error appears in the above-identified patent and that said Letters Patent is hereby corrected as shown below:

Column 3, line 49, "2000 Hz" should be "20000 Hz".

Signed and Sealed this

*Thirtieth* Day of *November 1982*

[SEAL]

*Attest:*

GERALD J. MOSSINGHOFF

*Attesting Officer*

*Commissioner of Patents and Trademarks*